US010895033B2

(12) United States Patent
Jiang

(10) Patent No.: US 10,895,033 B2
(45) Date of Patent: Jan. 19, 2021

(54) WASHING MACHINE

(71) Applicant: Yi Jiang, Scarborough (CA)

(72) Inventor: Yi Jiang, Scarborough (CA)

( * ) Notice: Subject to any disclaimer, the term of this patent is extended or adjusted under 35 U.S.C. 154(b) by 816 days.

(21) Appl. No.: 15/361,586

(22) Filed: Nov. 28, 2016

(65) Prior Publication Data

US 2018/0148879 A1 May 31, 2018

(51) Int. Cl.

| | |
|---|---|
| ***D06F 37/30*** | (2020.01) |
| ***D06F 15/00*** | (2006.01) |
| *D06F 37/04* | (2006.01) |
| *D06F 39/00* | (2020.01) |
| *D06F 37/26* | (2006.01) |
| *D06F 37/28* | (2006.01) |

(52) U.S. Cl.
CPC ..... *D06F 37/30* (2013.01); *D06F 15/00* (2013.01); *D06F 37/04* (2013.01); *D06F 37/262* (2013.01); *D06F 37/28* (2013.01); *D06F 39/006* (2013.01)

(58) Field of Classification Search
CPC ..... D06F 37/30
See application file for complete search history.

(56) References Cited

U.S. PATENT DOCUMENTS

| | | | | |
|---|---|---|---|---|
| 430,548 | A | 6/1890 | Sohn | |
| 813,015 | A | 2/1906 | Munson | |
| 895,518 | A | 8/1908 | Victor | |
| 1,022,825 | A | 4/1912 | Cammack | |
| 1,139,893 | A | 5/1915 | More | |
| 1,161,480 | A | 11/1915 | Keyser | |
| 1,209,981 | A | 12/1916 | Lyche | |
| 1,270,379 | A | 6/1918 | Coffield | |
| 1,387,365 | A | 8/1921 | Dienner | |
| 1,522,347 | A | 1/1925 | Vanderbosch | |
| 1,678,018 | A | 7/1928 | More et al. | |
| 1,763,865 | A | 6/1930 | Rocke | |
| 4,638,676 | A | 1/1987 | Lively et al. | |
| 4,726,402 | A | 2/1988 | Oppl | |
| 9,115,462 | B1 * | 8/2015 | Goldberg | D06F 37/32 |
| 2015/0159310 | A1 * | 6/2015 | Jiang | D06F 33/06 68/17 R |

FOREIGN PATENT DOCUMENTS

| | | |
|---|---|---|
| GB | 2177429 | 1/1987 |
| JP | 5915540 | 1/1984 |

* cited by examiner

*Primary Examiner* — Jason Y Ko

(57) ABSTRACT

A washing machine includes a washing-basket assembly including a rotatable shaft configured to be rotatably supported. A gear assembly is configured to engage with the rotatable shaft. A foot-peddle assembly is coupled to the gear assembly. This is done in such a way that the foot-peddle assembly, in use, urges a rotatable reciprocating movement of the gear assembly, the rotatable shaft and the washing-basket assembly.

8 Claims, 4 Drawing Sheets

WASHING MACHINE

TECHNICAL FIELD

This document relates to the technical field of (and is not limited to) a washing machine (and method therefor).

BACKGROUND

A washing machine (laundry machine, clothes washer, or washer) is a machine configured to wash laundry, such as clothing and sheets. Washing includes the operations of immersing, dipping, rubbing, and/or scrubbing the laundry in water (at least partially), usually accompanied by detergent, or bleach. The simplest machines may simply agitate the clothes in water (at least partially), while automatic machines may fill, empty, wash, spin, and heat during a cycle. Most washing machines remove substantial amounts of water from the laundry at the end of a wash cycle, but do not completely dry the laundry.

SUMMARY

It will be appreciated that there exists a need to mitigate (at least in part) at least one problem associated with the existing (known) washing machines (also called the existing technology). After much study of the known systems and methods with experimentation, an understanding of the problem and its solution has been identified and is articulated as follows:

There have been many efforts to create human-powered washing machines. Some of these efforts have arisen out of a concern for environmental awareness (such as energy conservation and/or water conservation), and as a result several human-powered washing machines have been developed. Examples of human-powered washing machines are driven by pedal-crank power or by hand-crank power, and are targeted at campers, single people and business people because of their portability and compact form. Known human-powered washing machines are defective in that when their wash baskets are rotated along their rotational axis, the washing machines are prone to an unacceptable amount of vibration due to improper rotation (ineffective rotation) of the wash basket.

Moreover, known human-powered washing machines are limited in the degree of reciprocating movement of the washing basket, and as a result, the washing action imparted from the washing basket to clothing items (received by the washing basket) could be more effective (such as, for more effective cleaning action, or for more effective cleaning action that requires less work effort for humans, or for more effective cleaning action that requires less energy input for the case where the washing machine is electrically powered).

It will be appreciated that the solution(s), to be provided, may be directed to mitigating (at least in part) at least some of the problems associated with known human-powered washing machines and/or with known washing machines (powered by electricity).

To mitigate, at least in part, at least one problem associated with the existing technology, there is provided (in accordance with a major aspect) an apparatus. The apparatus includes a washing machine (also called a human-powered washing machine). The washing machine includes a washing basket assembly including a rotatable shaft configured to be rotatably supported. A gear assembly is configured to engage (either directly or indirectly) with the rotatable shaft.

A foot-peddle assembly is coupled (either directly or indirectly) to the gear assembly. This is done in such a way that the foot-peddle assembly, in use, urges a rotatable reciprocating movement of the gear assembly, the rotatable shaft and the washing basket. Reciprocating movement of the washing basket, in use, improves the washing action imparted from the washing basket to a clothing item received by the washing basket.

To mitigate, at least in part, at least one problem associated with the existing technology, there is provided (in accordance with a major aspect) a method of operating a washing machine. The method includes coupling a foot-peddle assembly to a gear assembly configured to engage with a rotatable shaft of a washing-basket assembly, in which the rotatable shaft is configured to be rotatably supported, in such a way that the foot-peddle assembly, in use, urges a rotatable reciprocating movement of the gear assembly, the rotatable shaft and the washing-basket assembly. Reciprocating movement of the washing-basket assembly, in use, improves the washing action imparted from the washing-basket assembly to a clothing item received by the washing-basket assembly.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
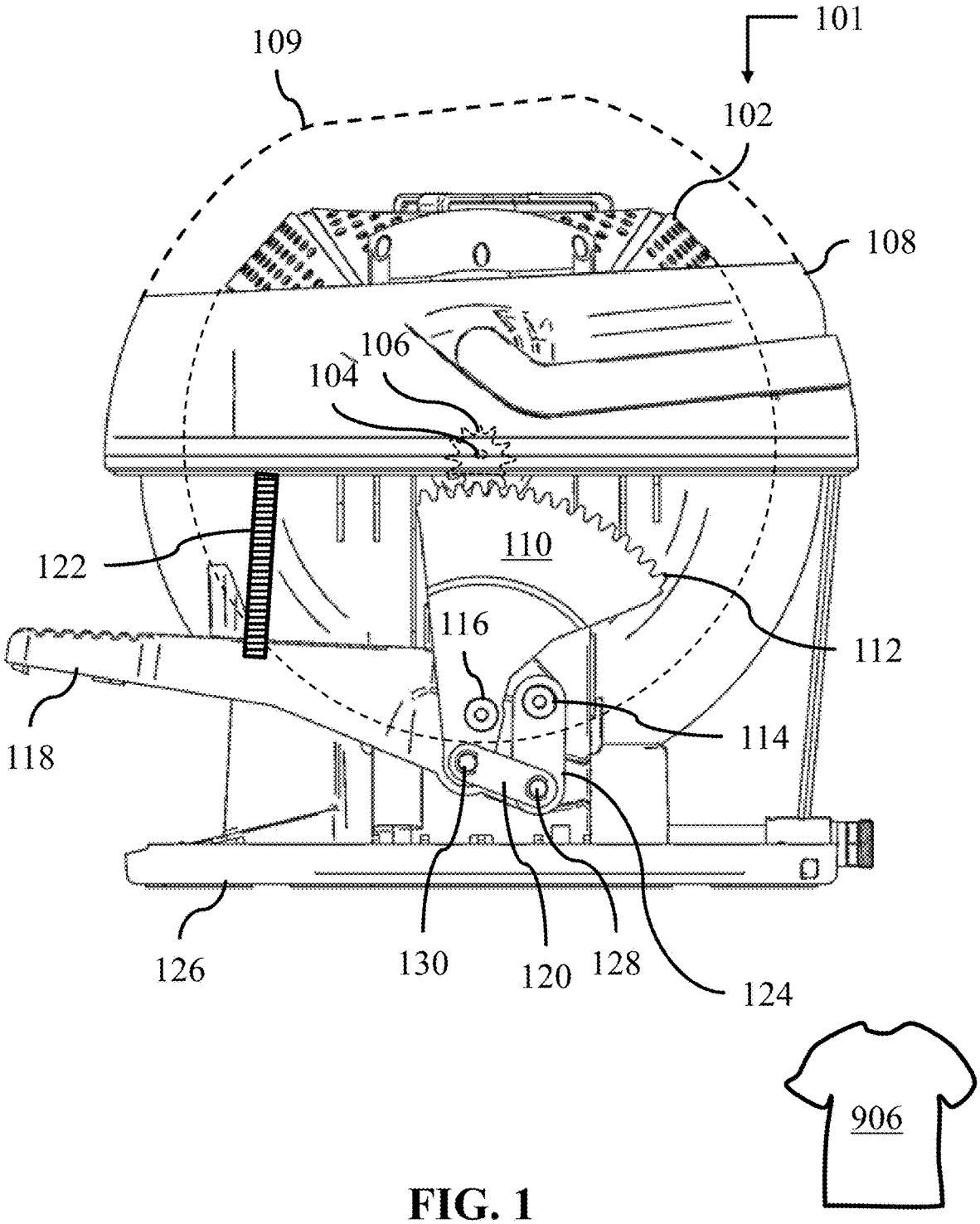
FIG. 1 depicts a side view of an embodiment of a washing machine.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

101 washing machine
102 washing-basket assembly
104 rotatable shaft
106 shaft teeth
108 stationary housing assembly
109 lid assembly
110 gear assembly
111 clothing lid
112 gear teeth
114 first pivotal mounting point
116 second pivotal mounting point
118 foot-peddle assembly
120 link assembly
122 biasing assembly
124 peddle extension
126 base assembly
128 first link connection
130 second link connection
132 reciprocal motion
134 reciprocal motion
902 foot
904 user
906 downward force

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of may be defined by the claims (in which the claims may be amended during patent examination after filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

FIG. 1 depicts a side view of an embodiment of a washing machine 101.

Referring to the embodiment as depicted in FIG. 1, the washing machine 101 includes (and is not limited to) a washing-basket assembly 102. Components of the washing machine 101 may be made of plastic parts (made with an injection molding system), or metal, etc. The washing machine 101 may be called a human-powered washing machine. The washing machine 101 further includes a stationary housing assembly 108 mounted to a base assembly 126. The washing-basket assembly 102 is configured to be rotatably mounted to the stationary housing assembly 108. A lid assembly 109 is removed from the stationary housing assembly 108. This is done in such a way that the washing-basket assembly 102 is partially revealed (and is accessible to the user 904).

Figure 2:
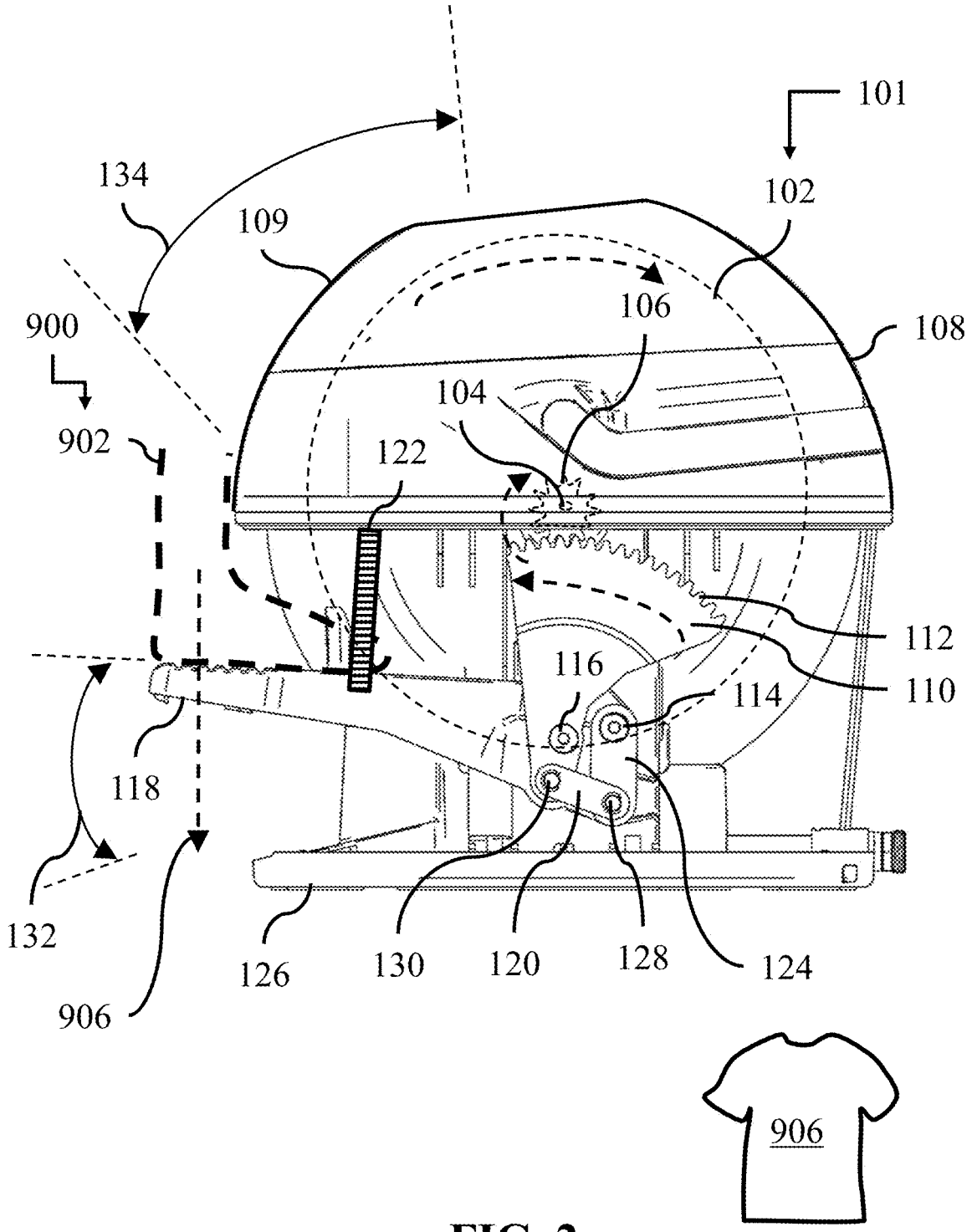
FIG. 2 depicts another side view of an embodiment of the washing machine of FIG. 1.
Figure 3:
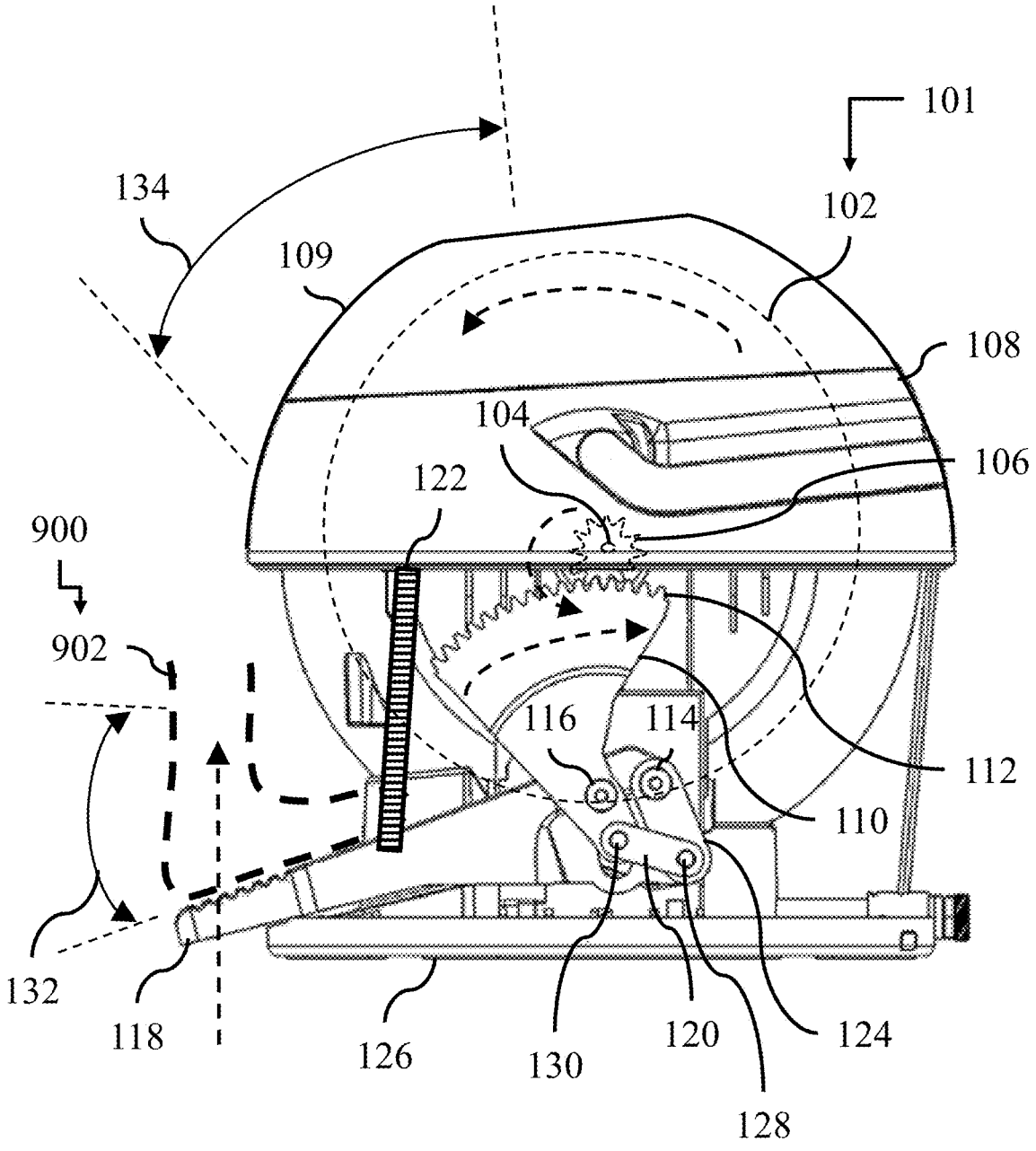
FIG. 3 depicts yet another side view of an embodiment of the washing machine of FIG. 1.

FIG. 2 and FIG. 3 depict side views of embodiments of the washing machine 101 of FIG. 1.

Referring to the embodiment as depicted in FIG. 2 and FIG. 3, an apparatus includes (and is not limited to) the washing machine 101. The washing machine 101 includes (and is not limited to) a synergistic combination of a washing-basket assembly 102, a gear assembly 110, and a foot-peddle assembly 118. The washing-basket assembly 102 includes a rotatable shaft 104 (preferably made of metal) configured to be rotatably supported. The gear assembly 110 (preferably made of metal) is configured to engage (either directly or indirectly) with the rotatable shaft 104. The foot-peddle assembly 118 is coupled (either directly or indirectly) to the gear assembly 110. This is done in such a way that the foot-peddle assembly 118, in use, urges a rotatable reciprocating movement of the gear assembly 110, the rotatable shaft 104 and the washing-basket assembly 102. A technical effect of the above arrangement of technical features is that the reciprocating movement of the washing-basket assembly 102, in use, improves the washing action imparted from the washing-basket assembly 102 to a clothing item 900 received by the washing-basket assembly 102.

Referring to the embodiment as depicted in FIG. 2 and FIG. 3, the washing machine 101 further includes a link assembly 120 configured to link (either directly or indirectly) the foot-peddle assembly 118 to the gear assembly 110. The link assembly 120 is configured to permit a relatively smaller reciprocating movement of the foot-peddle assembly 118 and a relatively larger rotatable reciprocating movement of the gear assembly 110 and the washing-basket assembly 102. This is done in such a way that a relatively larger rotatable reciprocating movement of the washing-basket assembly 102, in use, improves the washing action imparted from the washing-basket assembly 102 to the clothing item 900 received by the washing-basket assembly 102.

Referring to the embodiment as depicted in FIG. 2 and FIG. 3, the washing machine 101 further includes a biasing assembly 122. The biasing assembly 122 may include a spring assembly, an elastic member, and any equivalent thereof, etc. The biasing assembly 122 is configured to bias (either directly or indirectly) the foot-peddle assembly 118 from: (A) a first position (as depicted in FIG. 3), in which the foot-peddle assembly 118 has reached a maximum downward travel, to (B) a second position (as depicted in FIG. 2), in which the foot-peddle assembly 118 has reached a maximum upward travel. This is done in such a way that the biasing assembly 122, in use, urges the automatic return of the foot-peddle assembly 118 from the first position (as depicted in FIG. 3) to the second position (as depicted in FIG. 2), in which the foot-peddle assembly 118 may receive a downward force 906 from the foot 902 of the user 904.

Referring to the embodiment as depicted in FIG. 2 and FIG. 3, the washing-basket assembly 102 is configured to receive a clothing item 900. The washing machine 101 further includes a rotatable shaft 104 having shaft teeth 106 configured to be fixedly connected to (affixed to and extending through) the washing-basket assembly 102. More specifically, the rotatable shaft 104 is configured to be fixedly connected to (affixed to and extending through) the washing-basket assembly 102 in such a way that once the rotatable shaft 104 is made to rotate, the rotatable shaft 104, in use, rotates the washing-basket assembly 102.

The stationary housing assembly 108 is configured to rotatably support (by usage of bearings, etc.) rotation movement of the rotatable shaft 104 and the washing-basket assembly 102. More specifically, the stationary housing assembly 108 is configured to rotatably support (such as by the usage of bearings, etc.) the rotatable shaft 104 in such a way that the stationary housing assembly 108, in use, supports the rotation movement of the rotatable shaft 104 and the washing-basket assembly 102. The stationary housing assembly 108 provides a first pivotal mounting point 114 and a second pivotal mounting point 116 being spaced apart from the first pivotal mounting point 114 (the first pivotal mounting point 114 and the second pivotal mounting point 116 are stationary relative to each other).

The gear assembly 110 is configured to be rotatably supported by the stationary housing assembly 108. The gear assembly 110 has gear teeth 112 configured to engage with the shaft teeth 106 of the rotatable shaft 104. More specifically, the gear assembly 110 may be called a partially toothed gear assembly, etc., and any equivalent thereof. The gear assembly 110 is configured to be rotatably supported by the first pivotal mounting point 114 of the stationary housing assembly 108 in such a way that the gear assembly 110 is pivotally reciprocated relative to the stationary housing assembly 108 (in a back-and-forth manner). The gear assembly 110 has gear teeth 112 configured to engage with the shaft teeth 106 of the rotatable shaft 104 in such a way that the gear teeth 112, in use, rotate the rotatable shaft 104 via the shaft teeth 106.

The foot-peddle assembly 118 is configured to be biasedly mounted relative to the stationary housing assembly 108. The foot-peddle assembly 118 is coupled to the gear assembly 110 in such a way that the foot-peddle assembly 118, in use, urges a rotatable reciprocating movement of the gear assembly 110 (in a back-and-forth manner). In response (to the rotatable reciprocating movement of the gear assembly 110), the gear assembly 110, in use, urges a rotatable reciprocating movement of the washing-basket assembly 102 and the rotatable shaft 104, once the foot-peddle assembly 118 is reciprocated (in a back-and-forth manner). The reciprocating movement of the washing-basket assembly 102, in use, improves the washing action imparted from the washing-basket assembly 102 to a clothing item 900 that is received by the washing-basket assembly 102.

More specifically, the foot-peddle assembly 118 is configured to be rotatably reciprocated (in a back-and-forth manner, such as by being stepped on by the foot 902 of a user 904). The foot-peddle assembly 118 is configured to be biasedly mounted (such as, by usage of a spring assembly, etc.) relative to, and rotatably supported by, the second pivotal mounting point 116 of the stationary housing assembly 108 in such a way that the foot-peddle assembly 118, in use, rotatably reciprocates relative to the stationary housing assembly 108 once the foot-peddle assembly 118 is rotatably reciprocated relative to the stationary housing assembly 108 (the foot 902 of the user 904, in use, steps on the foot-peddle assembly 118). The foot-peddle assembly 118 is coupled (directly or indirectly) to the gear assembly 110 in such a way that the foot-peddle assembly 118, in use, urges a rotatable reciprocating movement of the gear assembly 110 (in a back-and-forth manner) once the foot-peddle assembly 118 is reciprocated (in a back-and-forth manner), and, in response, the gear assembly 110, in use, urges a rotatable reciprocating movement of the washing-basket assembly 102 and the rotatable shaft 104 once the foot-peddle assembly 118 is reciprocated (in a back-and-forth manner). The reciprocating movement of the washing-basket assembly 102, in use, improves the washing action imparted from the washing-basket assembly 102 to the clothing item 900 that is received by the washing-basket assembly 102.

Referring to the embodiment as depicted in FIG. 2 and FIG. 3, the link assembly 120 is configured to link the foot-peddle assembly 118 to the gear assembly 110 in such a way that the link assembly 120, in use, facilitates the transfer of reciprocal movement from the foot-peddle assembly 118 to the gear assembly 110. A relatively larger rotatable reciprocating movement of the washing-basket assembly 102, in use, improves the washing action imparted from the washing-basket assembly 102 to the clothing item 900 received by the washing-basket assembly 102. More specifically, the link assembly 120 is configured to link the foot-peddle assembly 118 to the gear assembly 110 in such a way that the link assembly 120, in use, facilitates the transfer of reciprocal movement from the foot-peddle assembly 118 to the gear assembly 110. In response to the gear assembly 110, in use, receiving reciprocating movement from the foot-peddle assembly 118, the gear assembly 110, in use, pivotally moves the gear teeth 112 of the gear assembly 110 and urges the shaft teeth 106 to rotate (a rotation of the shaft teeth 106) of the rotatable shaft 104, in which the rotation of the rotatable shaft 104, in use, urges a rotation of the washing-basket assembly 102. The link assembly 120 is configured to provide a relatively larger rotatable reciprocating movement of the washing-basket assembly 102, which improves the washing action imparted from the washing-basket assembly 102 to the clothing item 900 received by the washing-basket assembly 102.

In accordance with a preferred embodiment, the foot-peddle assembly 118 includes a peddle extension 124 that is fixedly attached to the foot-peddle assembly 118, and extends downwardly from the foot-peddle assembly 118. The link assembly 120 is rotatably connected to the peddle extension 124 at a first link connection 128. The link assembly 120 is also rotatably connected to the gear assembly 110 at a second link connection 130. The peddle extension 124, in use, improves the washing action imparted from the washing-basket assembly 102 to a clothing item 900 received by the washing-basket assembly 102.

In accordance with a preferred embodiment, the washing machine 101 further includes a biasing assembly 122 configured to bias the foot-peddle assembly 118 relative to the stationary housing assembly 108. This is done in such a way that the biasing assembly 122, in use, urges the foot-peddle assembly 118 to return from a biased positioned (as depicted in FIG. 3) to an unbiased position or a neutral position (as depicted in FIG. 2). In the unbiased position of the foot-peddle assembly 118, the foot 902 of the user 904, in use, steps down on the foot-peddle assembly 118. The biasing assembly 122, at least in part, assists in the reciprocating movement of the washing-basket assembly 102, and improves (at least in part) the washing action imparted from the washing-basket assembly 102 to a clothing item 900 received by the washing-basket assembly 102.

In accordance with an embodiment, the range of reciprocal motion 132 of the foot-peddle assembly 118 is about 21 degrees, and the range of reciprocal motion 134 of the gear assembly 110 is about 35 degrees.

Figure 4:
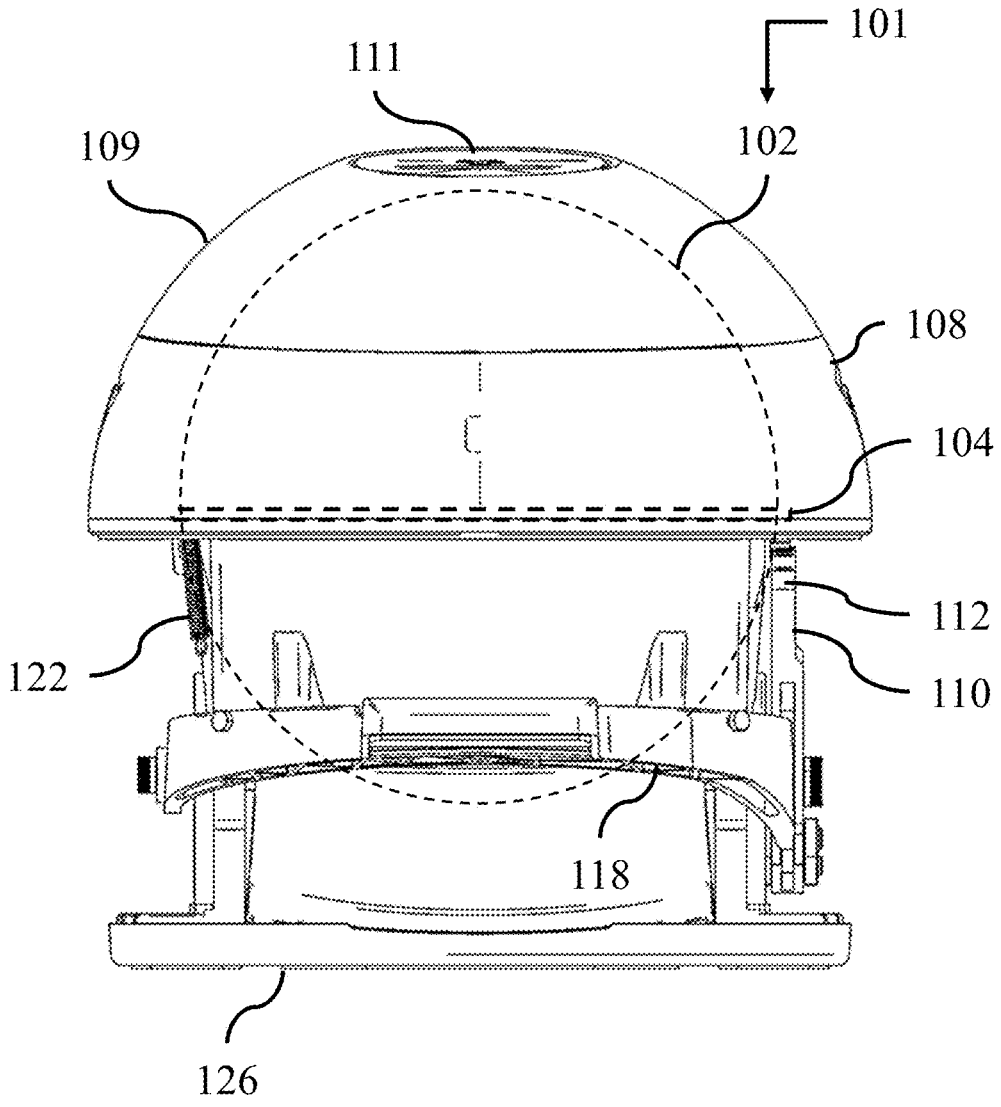
FIG. 4 depicts a front view of an embodiment of the washing machine of FIG. 1.

FIG. 4 depicts a front view of an embodiment of the washing machine 101 of FIG. 1.

Referring to the embodiment as depicted in FIG. 4, the washing machine 101 further includes a clothing lid 111. The clothing lid 111 is configured to selectively engage with, and disengage from, the lid assembly 109. The biasing assembly 122 is depicted on one side of the stationary housing assembly 108. It will be appreciated that an instance of the biasing assembly 122 is mounted to opposite sides of the stationary housing assembly 108. The instance of the biasing assembly 122 for the right side is not depicted so that a better view of the gear assembly 110 may be provided.

In accordance with a preferred embodiment, the foot-peddle assembly 118 spans across opposite sides of the stationary housing assembly 108. The foot-peddle assembly 118 is pivotally mounted to the opposite sides of the stationary housing assembly 108. The biasing assembly 122 is also mounted to the opposite sides of the stationary housing assembly 108. The biasing assembly 122 is mounted to the opposite sides of the foot-peddle assembly 118.

It is understood that each claim in the claims section is an open ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus (either explicitly or inherently). The apparatus may include any suitable combination and/or permutation of the technical features as identified in the detailed description, as may be required and/or desired to suit a particular technical purpose and/or technical function. It will be appreciated that, where possible and suitable, any one or more of the technical features of the apparatus may be combined with any other one or more of the technical features of the apparatus (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, unrecited elements or method steps. Comprising (comprised of) is an "open" phrase and allows coverage of technologies that employ additional, unrecited elements. When used in a claim, the word "comprising" is the transitory verb (transitional term) that separates the preamble of the claim from the technical features of the invention. The foregoing has outlined the nonlimiting embodiments (examples). The description is made for particular nonlimiting embodiments (examples). It is understood that the nonlimiting embodiments are merely illustrative as examples.

What is claimed is:

1. An apparatus, comprising:

a washing machine, comprising:

a washing-basket assembly including a rotatable shaft being configured to be rotatably supported; and a gear assembly being configured to engage with the rotatable shaft; and a foot-peddle assembly being coupled to the gear assembly in such a way that the foot-peddle assembly, in use, urges a rotatable reciprocating movement of the gear assembly, the rotatable shaft and the washing-basket assembly; and whereby the rotatable reciprocating movement of the washing-basket assembly, in use, improves a washing action imparted from the washing-basket assembly to a clothing item received by the washing-basket assembly; and a link assembly being configured to link the foot-peddle assembly to the pear assembly; and the link assembly being configured to permit a relatively smaller reciprocating movement of the foot-peddle assembly and a relatively larger rotatable reciprocating movement of the gear assembly and the washing-basket assembly; and whereby the relatively larger rotatable reciprocating movement of the washing-basket assembly, in use, improves the washing action imparted from the washing-basket assembly to the clothing item received by the washing-basket assembly.

2. The apparatus of claim 1, further comprising:

a biasing assembly being configured to bias the foot-peddle assembly from a first position, in which the foot-peddle assembly has reached a downward travel, to a second position, in which the foot-peddle assembly has reached an upward travel; and whereby the biasing assembly, in use, urges an automatic return of the foot-peddle assembly from the first position to the second position, in which the foot-peddle assembly may receive a downward force from a foot of a user.

3. An apparatus, comprising:

a washing machine, comprising:

a washing-basket assembly being configured to receive a clothing item; and a rotatable shaft having shaft teeth being configured to be fixedly connected to the washing-basket assembly; and a stationary housing assembly being configured to rotatably support a rotation movement of the rotatable shaft and the washing-basket assembly; and a gear assembly being configured to be rotatably supported by the stationary housing assembly; and the gear assembly having gear teeth being configured to engage with the shaft teeth of the rotatable shaft; and a foot-peddle assembly being configured to be biasedly mounted relative to the stationary housing assembly; and the foot-peddle assembly being coupled to the gear assembly in such a way that the foot-peddle assembly, in use, urges a rotatable reciprocating movement of the gear assembly, and, in response, the gear assembly, in use, urges the rotatable reciprocating movement of the washing-basket assembly and the rotatable shaft once the foot-peddle assembly is reciprocated; and whereby the rotatable reciprocating movement of the washing-basket assembly, in use, improves a washing action imparted from the washing-basket assembly to a clothing item received by the washing-basket assembly; and a link assembly being configured to link the foot-peddle assembly to the gear assembly in such a way that the link assembly, in use, facilitates a transfer of a reciprocal movement from the foot-peddle assembly to the gear assembly; and whereby a relatively larger rotatable reciprocating movement of the washing-basket assembly, in use, improves the washing action imparted from the washing-basket assembly to the clothing item received by the washing-basket assembly.

4. An apparatus, comprising:

a washing machine, comprising:

a washing-basket assembly being configured to receive a clothing item; and a rotatable shaft having shaft teeth; and the rotatable shaft being configured to be fixedly connected to the washing-basket assembly in such a way that once the rotatable shaft is made to rotate, the rotatable shaft, in use, rotates the washing-basket assembly; and a stationary housing assembly being configured to rotatably support the rotatable shaft in such a way that the stationary housing assembly, in use, supports a rotation movement of the rotatable shaft and the washing-basket assembly; and the stationary housing assembly providing a first pivotal mounting point and a second pivotal mounting point being spaced apart from the first pivotal mounting point, in which the first pivotal mounting point and the second pivotal mounting point are stationary relative to each other; and a gear assembly being configured to be rotatably supported by the first pivotal mounting point of the stationary housing assembly in such a way that the gear assembly is pivotally reciprocated relative to the stationary housing assembly; and the gear assembly having gear teeth being configured to engage with the shaft teeth of the rotatable shaft in such a way that the gear teeth, in use, rotate the rotatable shaft via the shaft teeth; and a foot-peddle assembly being configured to be rotatably reciprocated; and the foot-peddle assembly being configured to be biasedly mounted relative to, and rotatably supported by, the second pivotal mounting point of the stationary housing assembly in such a way that the foot-peddle assembly, in use, rotatably reciprocates relative to the stationary housing assembly once the foot-peddle assembly is rotatably reciprocated relative to the stationary housing assembly; and the foot-peddle assembly being coupled to the gear assembly in such a way that the foot-peddle assembly, in use, urges a rotatable reciprocating movement of the gear assembly once the foot-peddle assembly is reciprocated, and, in response, the gear assembly, in use, urges the rotatable reciprocating movement of the washing-basket assembly and the rotatable shaft once the foot-peddle assembly is reciprocated; and whereby the rotatable reciprocating movement of the washing-basket assembly, in use, improves a washing action imparted from the washing-basket assembly to a clothing item received by the washing-basket assembly.

5. The apparatus of claim 4, further comprising:

a link assembly being configured to link the foot-peddle assembly to the gear assembly in such a way that the link assembly, in use, facilitates transfer of reciprocal movement from the foot-peddle assembly to the gear assembly, and in response to the gear assembly, in use, receiving reciprocating movement from the foot-peddle assembly, the gear assembly, in use, pivotally moves the gear teeth of the gear assembly and urges a rotation of the shaft teeth of the rotatable shaft, in which the rotation of the rotatable shaft, in use, urges the rotation of the washing-basket assembly; and whereby a relatively larger rotatable reciprocating movement of the washing-basket assembly, in use, improves the washing action imparted from the washing-basket assembly to the clothing item received by the washing-basket assembly.

6. The apparatus of claim 4, further comprising:

a biasing assembly being configured to bias the foot-peddle assembly relative to the stationary housing assembly in such a way that the biasing assembly, in use, urges the foot-peddle assembly to return from a biased position to an unbiased position; and whereby the rotatable reciprocating movement of the washing-basket assembly, in use, improves the washing action imparted from the washing-basket assembly to a clothing item received by the washing-basket assembly.

7. The apparatus of claim 4, wherein:

the foot-peddle assembly includes a peddle extension that is fixedly attached to the foot-peddle assembly, and extends downwardly from the foot-peddle assembly; and a link assembly is rotatably connected to the peddle extension at a first link connection; and the link assembly is also rotatably connected to the gear assembly at a second link connection; and whereby the peddle extension, in use, improves the washing action imparted from the washing-basket assembly to a clothing item received by the washing-basket assembly.

8. The apparatus of claim 4, wherein:

a range of reciprocal motion of the foot-peddle assembly is about 21 degrees; and the range of reciprocal motion of the gear assembly is about 35 degrees.

* * * * *